US008302789B2

(12) United States Patent
Hanahara et al.

(10) Patent No.: US 8,302,789 B2
(45) Date of Patent: Nov. 6, 2012

(54) ROTATING SUPERSTRUCTURE AND CRANE

(75) Inventors: Akira Hanahara, Chita-gun (JP); Takeshi Nakatsu, Obu (JP)

(73) Assignee: Hitachi Sumitomo Heavy Industries Construction Cane Co., Ltd., Tokyo (JP)

( * ) Notice: Subject to any disclaimer, the term of this patent is extended or adjusted under 35 U.S.C. 154(b) by 48 days.

(21) Appl. No.: 12/712,538

(22) Filed: Feb. 25, 2010

(65) Prior Publication Data

US 2010/0213155 A1 Aug. 26, 2010

(30) Foreign Application Priority Data

Feb. 26, 2009 (JP) ..... 2009-043630

(51) Int. Cl.
*B66C 23/18* (2006.01)

(52) U.S. Cl. ..... 212/179; 212/175

(58) Field of Classification Search ..... 212/175, 212/179, 180, 181, 223, 255, 343, 271
See application file for complete search history.

(56) References Cited

U.S. PATENT DOCUMENTS

| | | | | | |
|---|---|---|---|---|---|
| 2,985,318 | A * | 5/1961 | Nickles et al. | ..... | 212/301 |
| 4,081,081 | A * | 3/1978 | Morrow et al. | ..... | 212/178 |
| 4,421,241 | A * | 12/1983 | Wittman et al. | ..... | 212/298 |
| 5,348,171 | A * | 9/1994 | Haman et al. | ..... | 212/304 |
| 6,568,547 | B1 * | 5/2003 | Kretschmer et al. | ..... | 212/196 |
| 6,871,427 | B2 * | 3/2005 | Muta et al. | ..... | 37/466 |
| 7,677,337 | B2 * | 3/2010 | Poeckl et al. | ..... | 175/162 |
| 2010/0072156 | A1 * | 3/2010 | Mentink et al. | ..... | 212/196 |

FOREIGN PATENT DOCUMENTS

| | | | |
|---|---|---|---|
| JP | 2007-230747 | A | 9/2007 |
| SU | 1537642 | A * | 1/1990 |

* cited by examiner

*Primary Examiner* — Emmanuel M Marcelo
*Assistant Examiner* — Juan Campos, Jr.
(74) *Attorney, Agent, or Firm* — Crowell & Moring LLP

(57) ABSTRACT

A rotating superstructure includes: a front block on which a power unit that includes a prime mover; and a rear block on which a unit for raising and lowering a boom that includes a winch, a, and an arm. And the rotating superstructure is configured to be split into the front block and the rear block.

12 Claims, 14 Drawing Sheets

ROTATING SUPERSTRUCTURE AND CRANE

INCORPORATION BY REFERENCE

The disclosure of the following priority application is herein incorporated by reference: Japanese Patent Application No. 2009-043630 filed Feb. 26, 2009

BACKGROUND OF THE INVENTION

1. Field of the Invention

The present invention related to a crane that repeats traveling and working and its rotating superstructure.

2. Description of Related Art

There is a rotating superstructure (revolving superstructure) known in the prior art, on which a power unit that includes an engine, a radiator and the like and a unit for raising and lowering a boom that includes a winch, an arm and the like are mounted and a counterweight is attached. In general, when a rotating superstructure is transported, the counterweight is removed from the rotating superstructure so as to reduce the transportation weight (for instance, refer to Japanese Laid Open Patent Publication No. 2007-230747).

SUMMARY OF THE INVENTION

When a mast for raising and lowering a boom is attached to the rotating superstructure, the length of a large crane may exceed the limit of the permitted length for transportation. Therefore, the rotating superstructure and the mast need to be transported separately. However, since a wire rope is wound between the mast and a raising/lowering winch, not only the mast but also the winch needs to be separated from the rotating superstructure. In addition, when the mast and the winch are transported, the winch needs to be temporarily fixed to the mast and, after the transportation, the mast and the winch need to be reattached to the rotating superstructure Accordingly, assembly and disassembly for transportation of the conventional rotating superstructure may become complicated.

According to the 1st aspect of the present invention, a rotating superstructure comprises: a front block on which a power unit that includes a prime mover; and a rear block on which a unit for raising and lowering a boom that includes a winch, a, and an arm, and the rotating superstructure is configured to be split into the front block and the rear block.

According to the 2nd aspect of the present invention, in the rotating superstructure according to the 1st aspect, it is preferred that the rotating superstructure further comprises: a pin that is provided on either one of the front block and the rear block so as to join the front block and the rear block each other; a pin fix member that is provided on the other one of the front block and the rear block, includes a guiding section so as to guide the pin to a fixed position when the front block and the rear block are joined to each other, and includes a lock section that locks the pin at the fixed position so as to prevent the front block and the rear block from being separated after the pin is guided to the fixed position.

According to the 3rd aspect of the present invention, in the rotating superstructure according to the 1st aspect, it is preferred that: the rotating superstructure further comprises a mast for raising and lowering a boom; and the rear block includes a member on which the mast is placed during transportation.

According to the 4th aspect of the present invention, in the rotating superstructure according to 1st aspect, it is preferred that the rotating superstructure is for a crane.

According to the 5th aspect of the present invention, a crane comprises: a rotating superstructure according to the 1st aspect; and a traveling undercarriage on which the rotating superstructure is rotatably mounted.

According to the 6th aspect of the present invention, a method for transporting a rotating superstructure comprises: splitting a rotating superstructure according to the 1st aspect into the front block and the rear block; transporting the front block and the rear block separately; and rejoining the front block and the rear block into the rotating superstructure after transportation.

According to the 7th aspect of the present invention, in the method for transporting a rotating superstructure according to the 6th aspect, it is preferred that a mast for raising and lowering a boom is transported together with the rear block.

DESCRIPTION OF PREFERRED EMBODIMENTS

Figure 1:
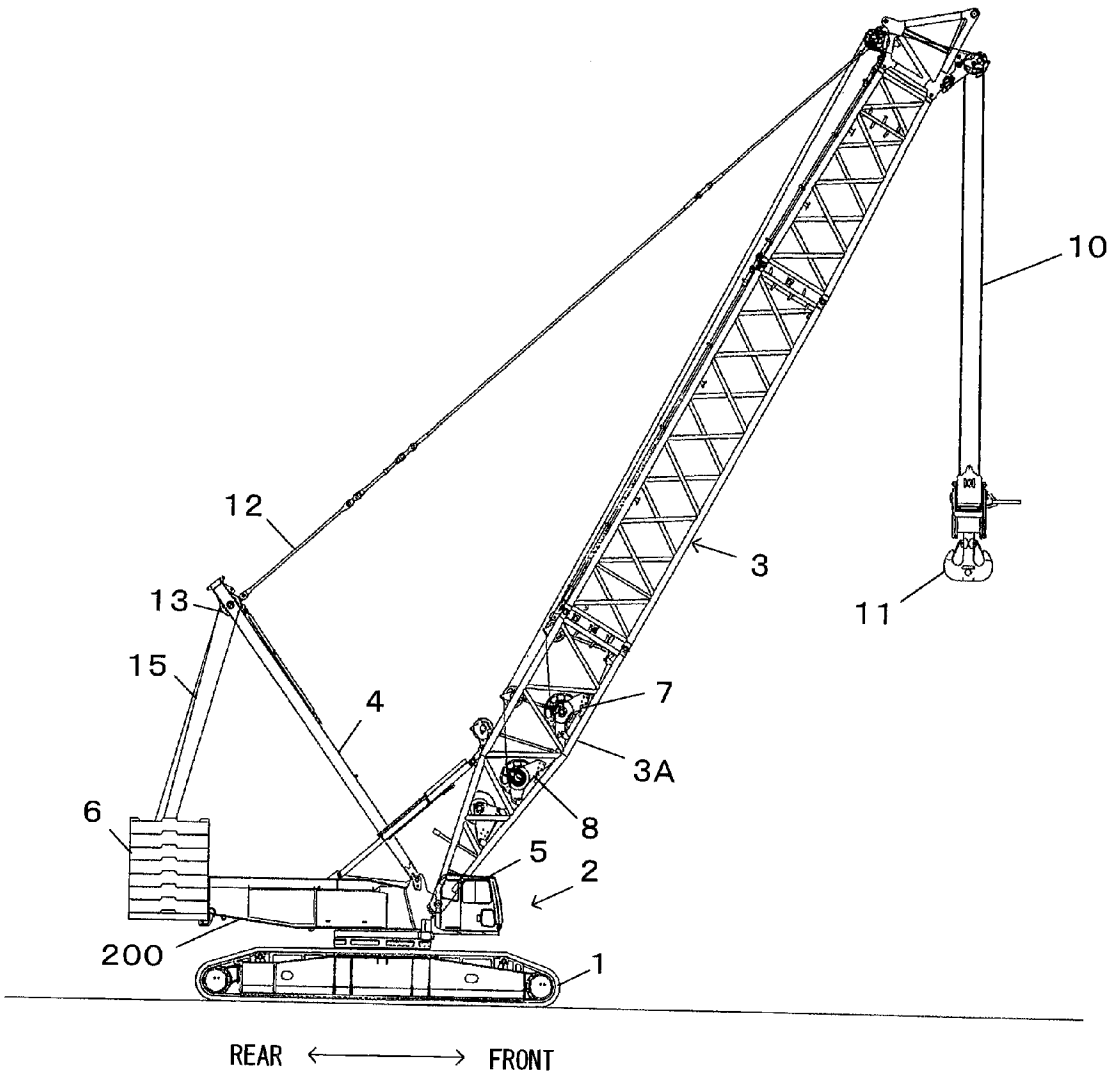
FIG. 1 is an external side view of a rotating superstructure related to an embodiment of the present invention and a crane on which the rotating superstructure is mounted.

An embodiment of a rotating superstructure (revolving superstructure) according to the present invention and a crane on which the rotating superstructure is mounted will be explained in reference to FIGS. 1 to 13. FIG. 1 is an external side view of the rotating superstructure related to an embodiment of the present invention and the crane on which the rotating superstructure is mounted. A rotating superstructure 2 is rotatably mounted above a traveling undercarriage 1. A boom 3 is forwardly and rearwardly pivotally coupled to the front section of the rotating superstructure 2 and a mast for raising and lowering a boom (raising/lowering mast or live mast) 4 is forwardly and rearwardly pivotally coupled to the rear section of the boom 3 over the rotating superstructure 2. The rotating superstructure 2 includes a operator's cab 5 that is supported by the front end portion of a main frame 200 (FIG. 2), a counterweight 6 that is supported by the rear end portion of the main frame 200, a front drum 7 and a rear drum 8 that are mounted on a base boom 3A, and a winch for raising and lowering a boom (raising/lowering drum or raising/lowering winch) 9 (refer to FIG. 2) that is mounted on the main frame 200.

A hook 11 is suspended from the end portion of the boom 3 via a wire rope 10. The wire rope 10 is wound up or paid out by the drive of the front drum 7 so as to move the hook 11 up and down. The end portion of the boom 3 and the end portion of the live mast 4 are connected via a pendant rope 12. The end portion of the live mast 4 and the rear end portion of the main frame 200 are provided with sheaves 13 and 14 (FIG. 2), respectively. A rope for raising and lowering a boom (raising/lowering rope) 15 is stretched between the sheave 13 and the sheave 14. The rope 15 is wound up or paid out by the drive of the winch 9 so as to rotate the live mast 4 and raise/lower the boom 3 via the pendant rope 12.

Figure 2:
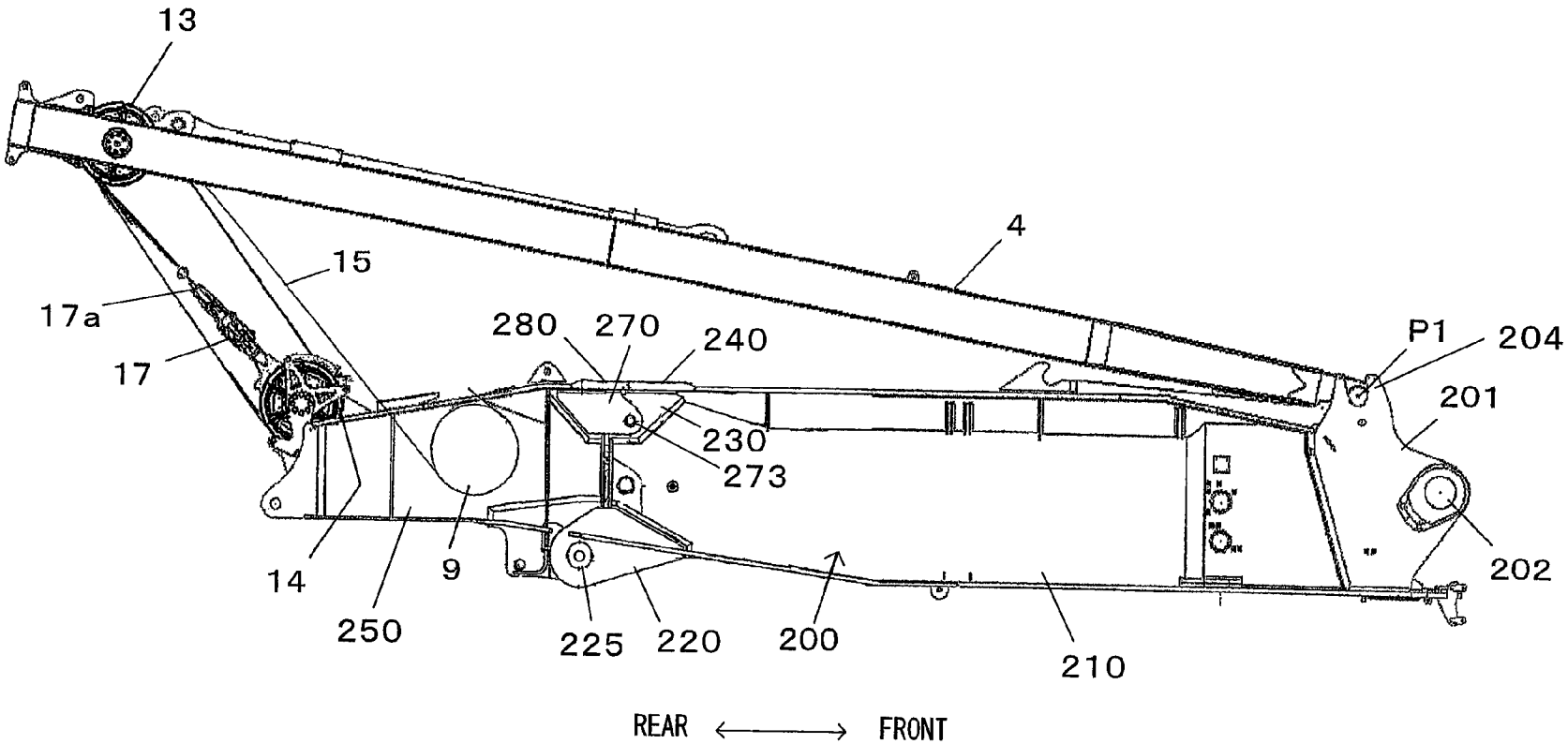
FIG. 2 is a side view of the main section of the live mast 4.

FIG. 2 is a side view of the main section of the live mast 4, showing the working position in which the live mast 4 is tilted backwards. It is to be noted that, although not shown, a posture with the live mast 4 rotated clockwise on the figure about P1 described later and tilted forwards is referred to as a forward tilt position, while a posture with the live mast 4 rotated backwards further than the working position presented in FIG. 2 and lying down to be substantially horizontal is referred to as a transportation position. It is to be noted that, in the transportation position, the live mast 4 is placed on stoppers 203 (refer to FIGS. 8 and 10) provided on the main frame 200 (a rear block 250 described later). The front end portion of the main frame 200 (a front block 210 described later) is provided with a bracket 201 and the live mast 4 is pivotally supported on an upper end portion 204 of the bracket 201 via the pin P1. The front end portion of the bracket 201 is provided with a boom support section 202 and the boom 3 is pivotally supported on the boom support section 202.

An arm for raising and lowering a boom (raising/lowering arm) 17 is forwardly and rearwardly pivotally supported between the sheave 13 and a sheave for raising and lowering a boom (raising/lowering sheave) 14 about a pivot axis (not shown) that is coaxial with the rotation axis of the sheave 14. The horizontal (depth direction on the figure) end portion of the arm 17 is provided with a rope support section 17*a* and the end portion of the rope 15 is connected to the rope support section 17*a*. The arm 17 is pulled towards the sheave 13 by tension of the rope 15 and the arm 17 rotates about the pivot axis as the live mast 4 rotates.

Although not shown, a hydraulic cylinder for the live mast is swingably supported from the main frame 200 below the base end portion of the live mast 4. When the hydraulic cylinder is stretched, its thrust force pushes the base end portion of the live mast 4 upward. As a result, the live mast 4 is raised up and shifted from the transportation position to the working position. When the hydraulic cylinder is fully stretched, the live mast 4 takes the forward tilt position. When the rope 15 is paid out in the forward tilt position, the live mast 4 rotates downward under its own weight. —The structure of the main frame 200 —

Figure 3:
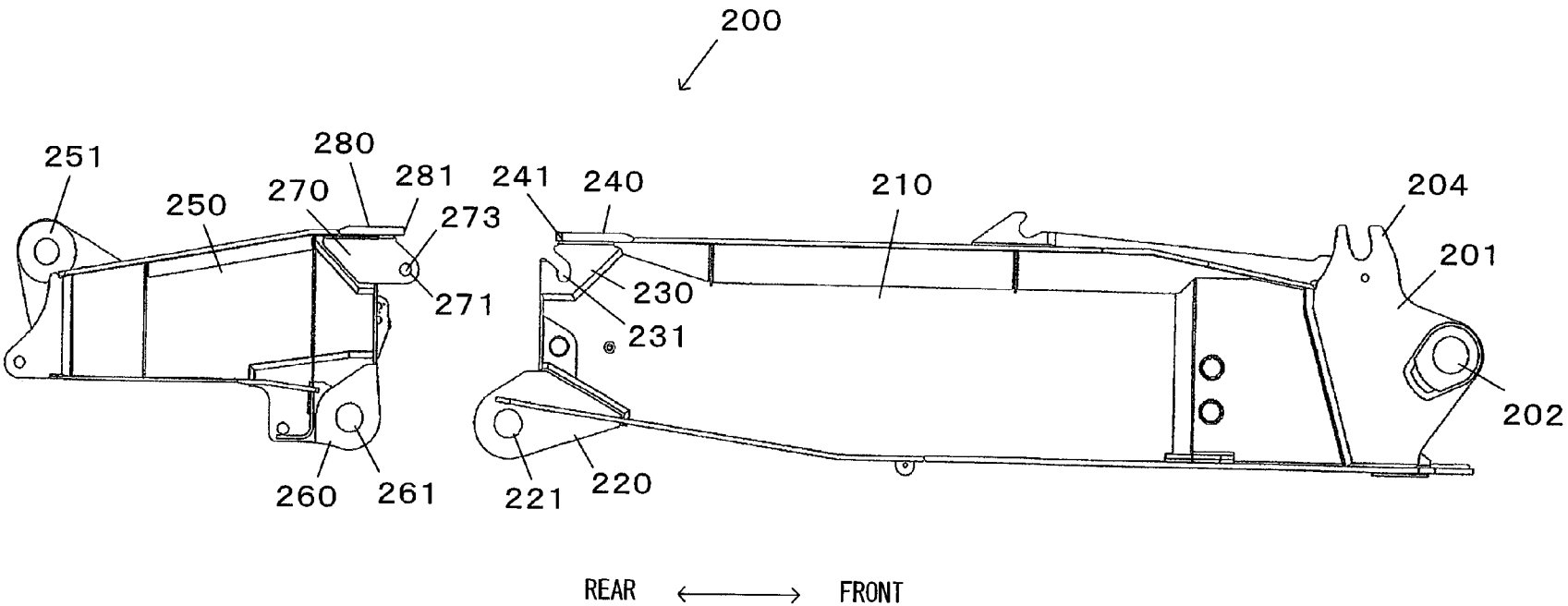
FIG. 3 is a side view showing the structure of the main frame 200.

As shown in FIG. 3, the main frame 200 includes two separable blocks, i.e., the front block 210 and the rear block 250. FIG. 3 is a side view of the main frame 200 having been separated into the front block 210 and the rear block 250. The rear section of the front block 210 is provided with a lower joining section 220, an upper joining section 230, and an abutment section (contact section) 24 0 so as to be coupled with the rear block 250. The front section of the rear block 250 is provided with a lower joining section 260, an upper joining section 270, an abutment section (contact section) 280 so as to be coupled with the front block 210. The rear end portion of the rear block 250 is provided with a pair of right and left support brackets 251 in a protruding manner so as to pivotally support the sheave 14 and the arm 17.

Figure 4:
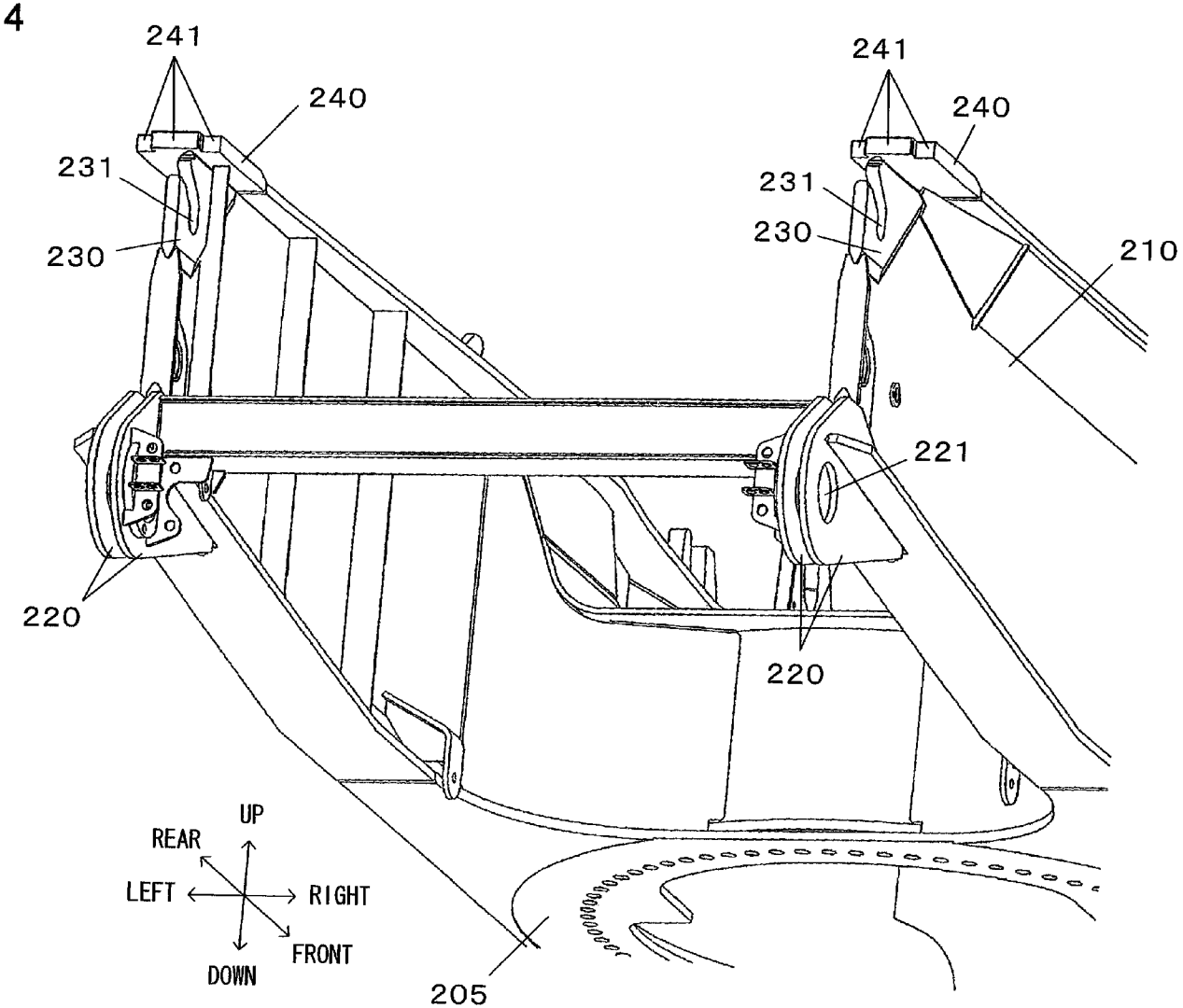
FIG. 4 is a perspective view of the rear section of the front block 210 seen from obliquely below.
Figure 5:
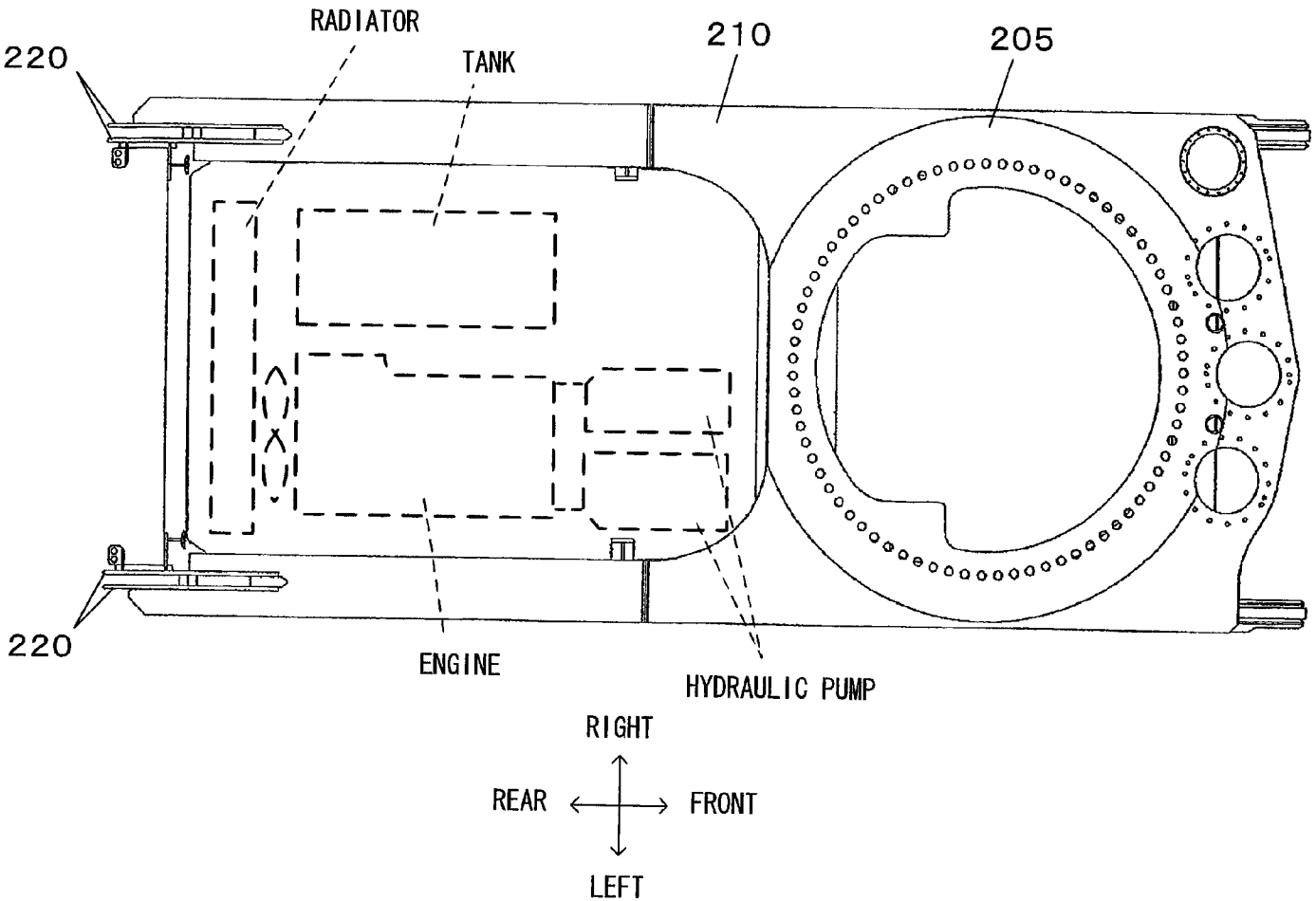
FIG. 5 is a view of the front block 210 seen from below.

FIG. 4 is a perspective view of the rear section of the front block 210 seen from obliquely below and FIG. 5 is a view of the front block 210 seen from below. The lower joining sections 220 are each plate-like members that extend in the front-back up-down direction each separately provided two by two at the lower right and left ends of the front block 210 and are each provided with a pin through-hole 221. The upper joining sections 230 are each thick plate-like members that extend in the front-back up-down direction each provided at the upper right and left ends of the front block 210 and are each provided with a pin guiding groove 231.

Figure 6A:
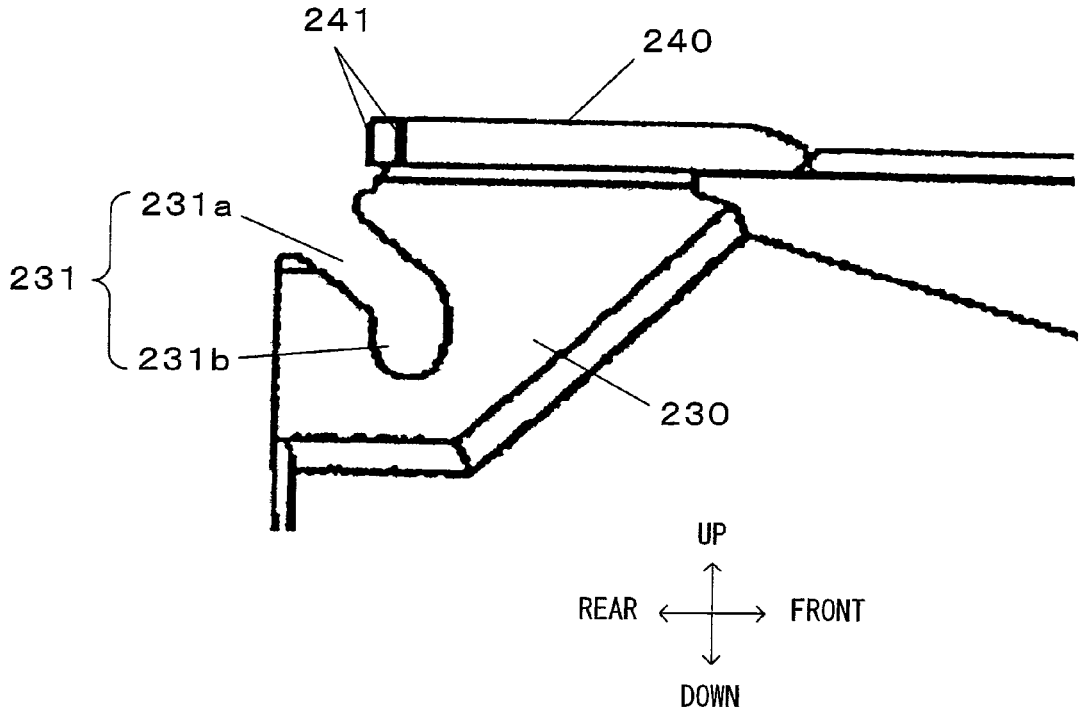
FIGS. 6A and 6B are enlarged views of the vicinity of the upper joining section 230.

FIG. 6A is an enlarged view of the vicinity of the upper joining section 230. The pin guiding groove 231 includes a groove section 231*a* that extends from obliquely above on the rear to obliquely below on the front and a groove section 231*b* that extends downward from the end obliquely below on the front of the groove section 231*a*. As described later in reference to FIG. 6B, when the front block 210 and the rear block 250 are joined, the pin guiding groove 231 guides a pin 273 attached to the rear block 250 to a fixed position (described later) and, after the front block 210 and the rear block 250 are joined, the pin guiding groove 231 locks the pin 273 so as to prevent the front block 210 and the rear block 250 from being separated.

The abutment sections 240 are each thick plate-like members that extend in the front-back right-left direction each provided at the upper right and left ends of the front block 210 and are each provided with an abutment surface (contact surface) 241. The abutment surfaces 241 are rear end surfaces of the thick plate-like abutment sections 240 and, as described later, abut or contact against abutment surfaces (contact surface) 281 of the abutment sections 280 of the rear block 250 when the front block 210 and the rear block 250 are joined.

Figure 7:
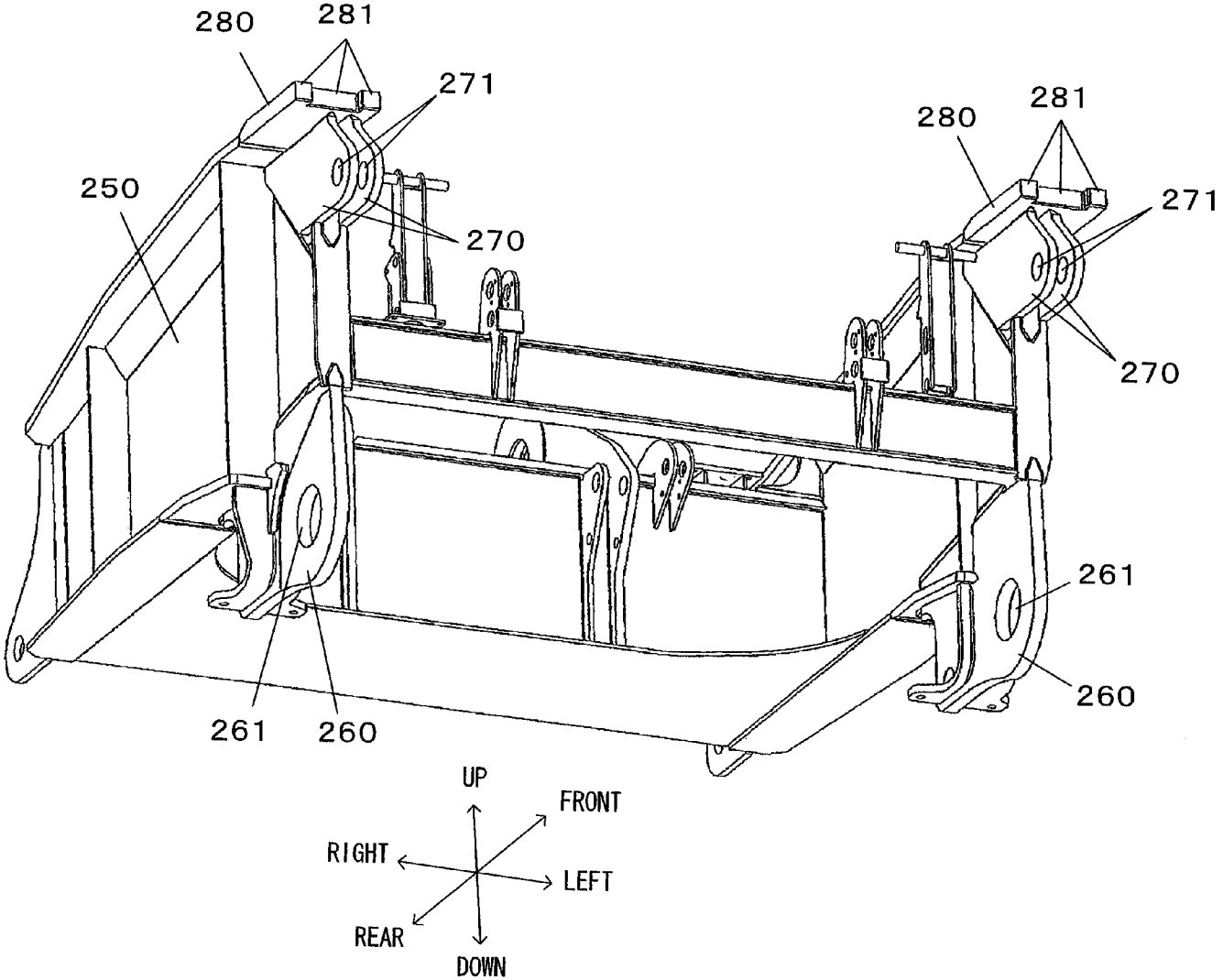
FIG. 7 is a perspective view of the front section of the rear block 250 seen from obliquely below.
Figure 8:
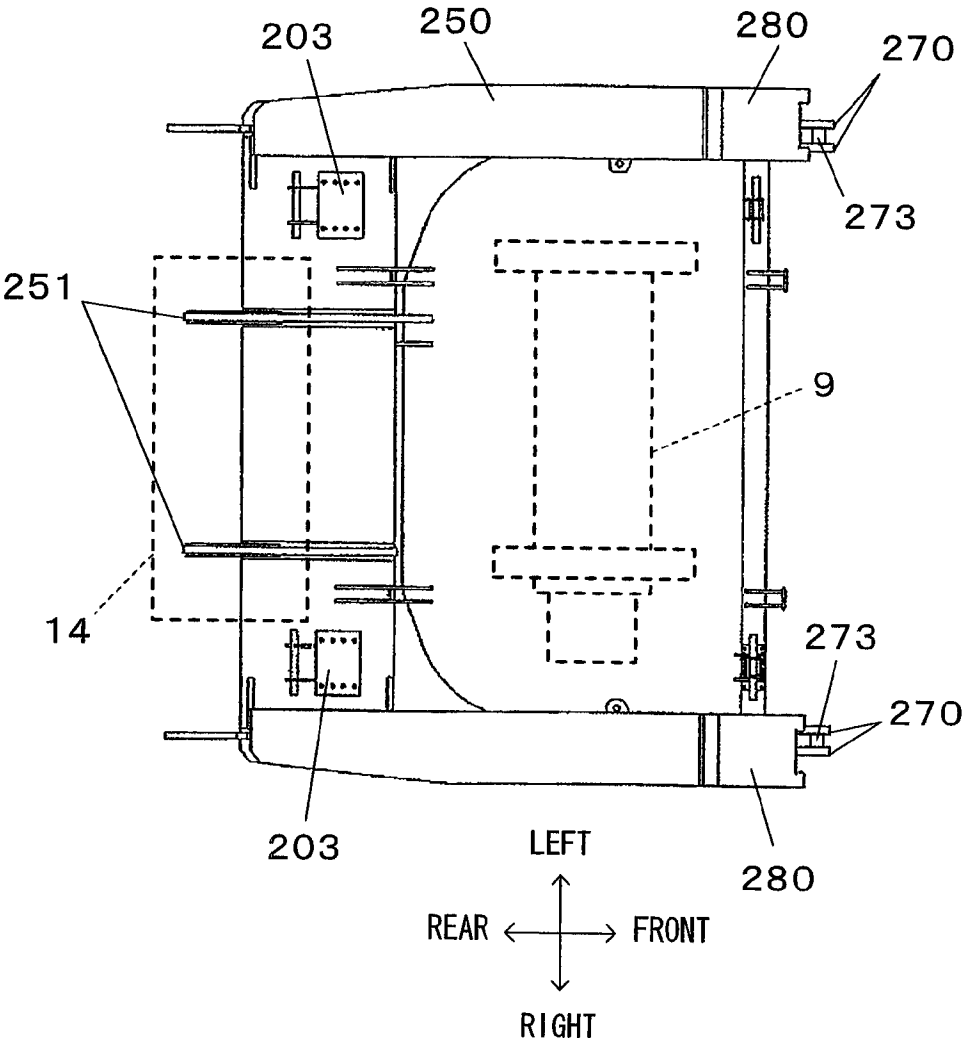
FIG. 8 is a plan view of the rear block 250 seen from above.

FIG. 7 is a perspective view of the front section of the rear block 250 seen from obliquely below and FIG. 8 is a plan view of the rear block 250 seen from the above. The lower joining sections 260 are each plate-like members that extend in the front-back up-down direction each provided at the lower right and left ends of the rear block 250 and are each provided with a pin through-hole 261. The upper joining sections 270 are each plate-like members that extend in the front-back up-down direction each separately provided two by two at the upper right and left ends of the rear block 250 and are each provided with a pin retaining hole 271 that retains the pin 273 (FIGS. 2 and 8).

The abutment sections 280 are each thick plate-like members that extend in the front-back right-left direction each provided at the upper right and left ends of the rear block 250 and are each provided with the abutment surface 281. The abutment surfaces 281 are front end surfaces of the thick plate-like abutment sections 280 and, as described later, abut against the abutment surfaces 241 of the abutment section 240 of the front block 210.

As shown in FIG. 5, a power unit that includes an engine, a radiator, a hydraulic pump, a fuel tank, and a hydraulic oil tank is arranged on the front block 210. The arrangement position of those equipment is indicated in dashed line in FIG. 5. It is to be noted that in FIG. 5, the numeral 205 represents an attachment section of a turntable. As shown in FIGS. 2 and 8, a unit for raising and lowering a boom that includes the winch 9, the sheave 14 and the arm 17 is arranged on the rear block 250. In FIG. 8, the arrangement positions of the winch 9 and the sheave 14 are indicated in dashed line.

When the front block 210 and the rear block 250 are joined/unjoined, a hydraulic piping, through which pressure oil is supplied from a hydraulic pump provided on the front block 210 to a hydraulic motor that drives the 9 and the like, also needs to be joined/unjoined. In the present embodiment, a pipe joint (not figured) is provided along hydraulic piping so as to promptly join/unjoin the piping and the pipe joint is joined/unjoined so as to join/unjoin the hydraulic piping arranged between the front block 210 and the rear block 250.

Since a hydraulic circuit of the rear block 250 is provided with sensors such as, for example, a pressure sensor (not figured) and the front block 210 is provided with a control circuit (not figured) of the hydraulic circuit, it is necessary to transmit/receive electrical signals between the front block 210 and the rear block 250. Accordingly, in the present embodiment, a connector (not figured) which can be promptly connected/disconnected is provided on electrical wiring arranged between the front block 210 the rear block 250 and this connector is connected/disconnected so as to connect/disconnect the electrical wiring arranged between the front block 210 and the rear block 250.

—Connection/Disconnection of the Front Block 210 and the Rear Block 250—

Figure 9:
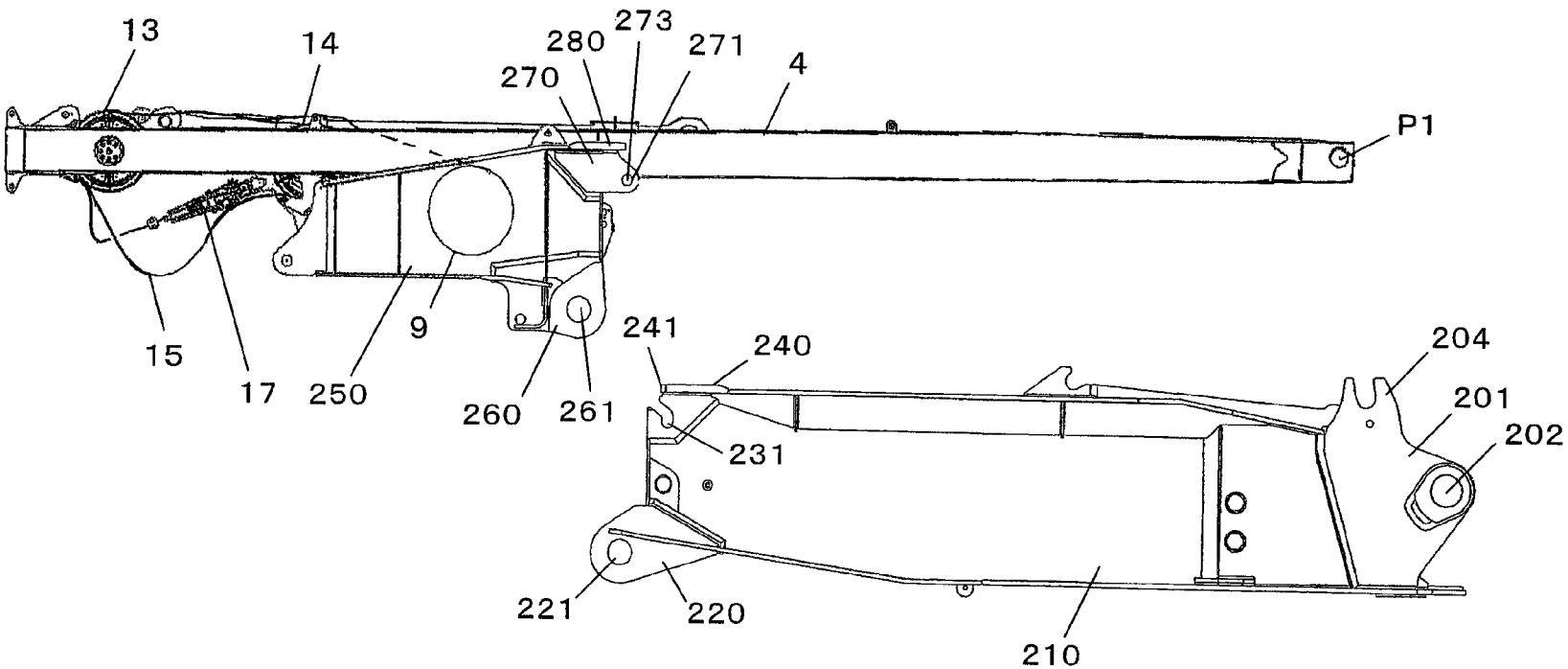
FIG. 9 is a view of the main frame 200 being separated into the front block 210 on which the operator's cab 5 and a power unit are mounted and the rear block 250 on which the live mast 4 and a unit for raising and lowering a boom are mounted.

As the rotating superstructure 2 is configured as described above, in the event of transportation, the main frame 200 is separated into the front block 210 on which the operator's cab 5 and the power unit are mounted and the rear block 250 on which the live mast 4 and the unit for raising and lowering a boom are mounted, which are separately transported in a manner presented in FIG. 9. The live mast 4 is temporarily fixed to the rear block 250 in the event of transportation. It is to be noted that the operator's cab 5 is not illustrated in FIG. 9.

In the event that the front block 210 and the rear block 250 are joined and fixed in the work site, a portion between the separated two upper joining sections 270 of the pin 273 attached to the pin retaining hole 271 of the rear block 250 is first inserted into the pin guiding groove 231 of the front block 210. As a result, as indicated by an arrow a in FIG., 6B, the pin 273 is guided in the groove section 231*a* of the pin guiding groove 231 from obliquely above on the rear to obliquely below on the front to reach the groove section 231*b* and the position of the pin 273 is determined at the bottom of the groove section 231*b*. This position is referred to as the fixed position of the pin 273. After the insertion of the pin 273, or prior to the insertion of the pin 273, the pin P1 of the live mast 4 is attached to the upper end portion 204 of the bracket 201. As shown in FIG. 9, since the upper end portion 204 is opened so that the pin P1 is guided and inserted thereinto, the pin P1 is inserted from above so as to be attach to the upper end portion 204.

Figure 10:
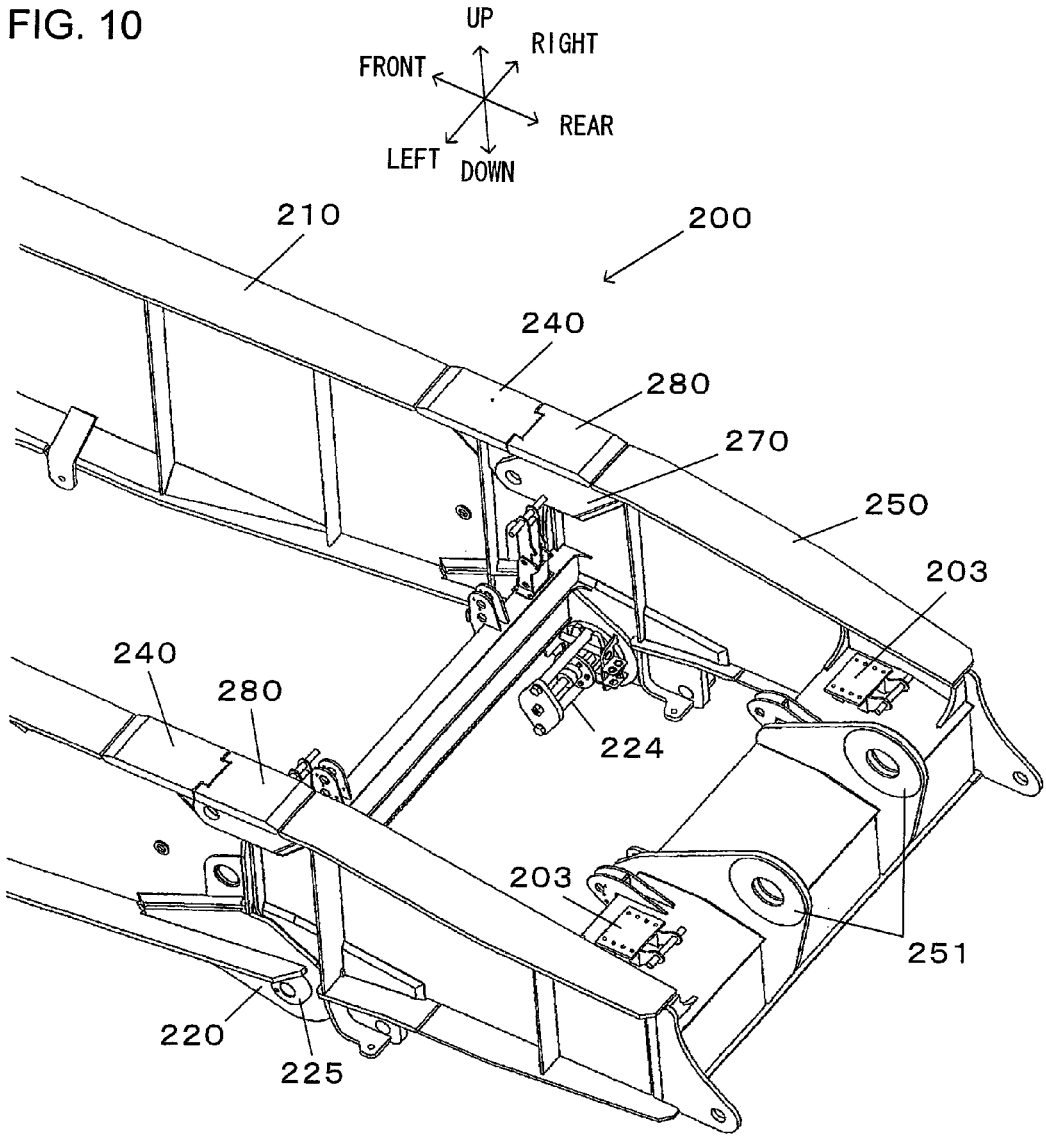
FIG. 10 is a perspective view of the front block 210 and the rear block 250 being joined together.
Figure 11:
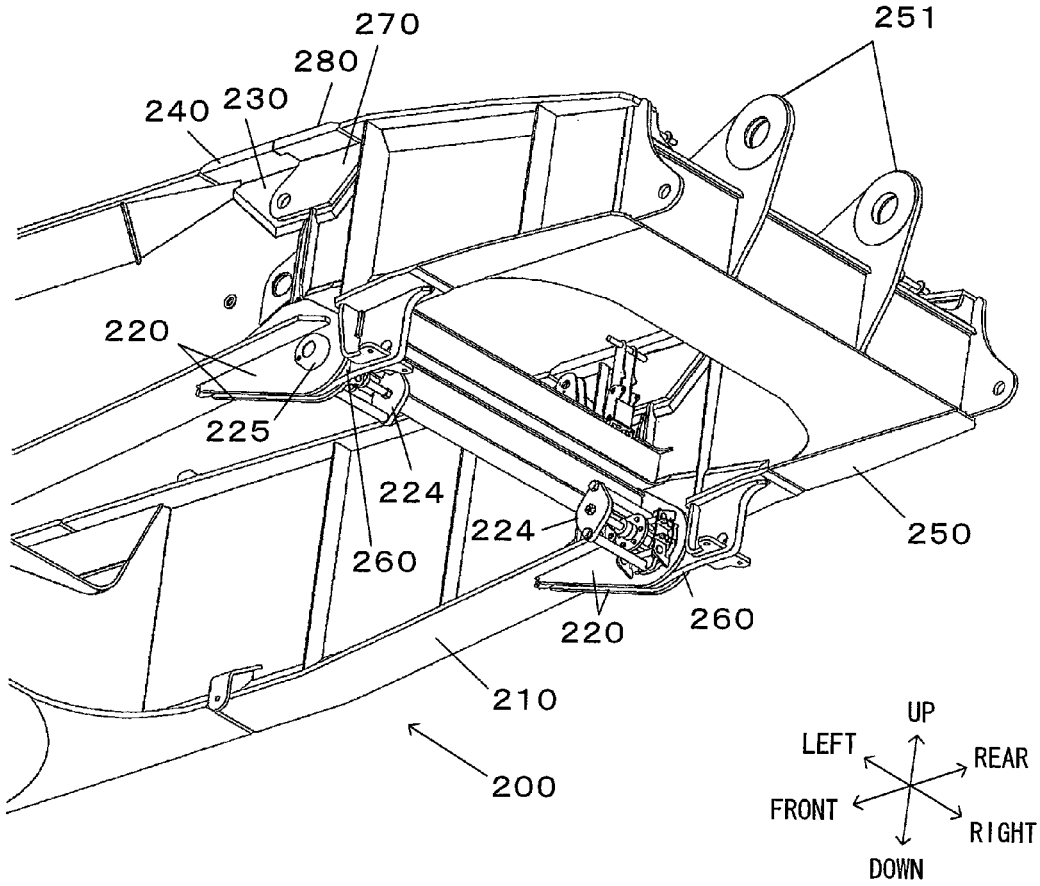
FIG. 11 is a perspective view of the front block 210 and the rear block 250 being joined together.

The lower joining section 260 of the rear block 250 is inserted between the separately provided two lower joining section 220 of the front block 210. After the pin 273 is inserted into the pin guiding groove 231 and guided to the fixed position, the positions of the pin through-hole 221 of the lower joining section 220 and the pin through-hole 261 of the lower joining section 260 are aligned and, as shown in FIGS. 10 and 11, a connection pin 225 is inserted into the pin through-hole 221 and the pin through-hole 261 so as to fix the lower joining section 220 of the front block 210 and the lower joining section 260 of the rear block 250. The connection pin 225 tapers towards the tip so as to be inserted into the pin through-holes 221 and 261 even without a strict alignment. It is to be noted that in FIGS. 10 and 11, the numeral 224 represents a connecting pin drive mechanism to insert/remove the connection pin 225 into/from the pin through-holes 221 and 261, which is driven by an actuator (not figured).

Through the above procedure, the front block 210 and the rear block 250 are joined. The above-described pipe joint and the connector are joined so as to connect the hydraulic piping and the electrical wiring arranged between the front block 210 and the rear block 250. It is to be noted that in the event that the front block 210 and the rear block 250 are unjoined, they are separated through the reverse procedure to the above-described procedure.

Figure 6B:
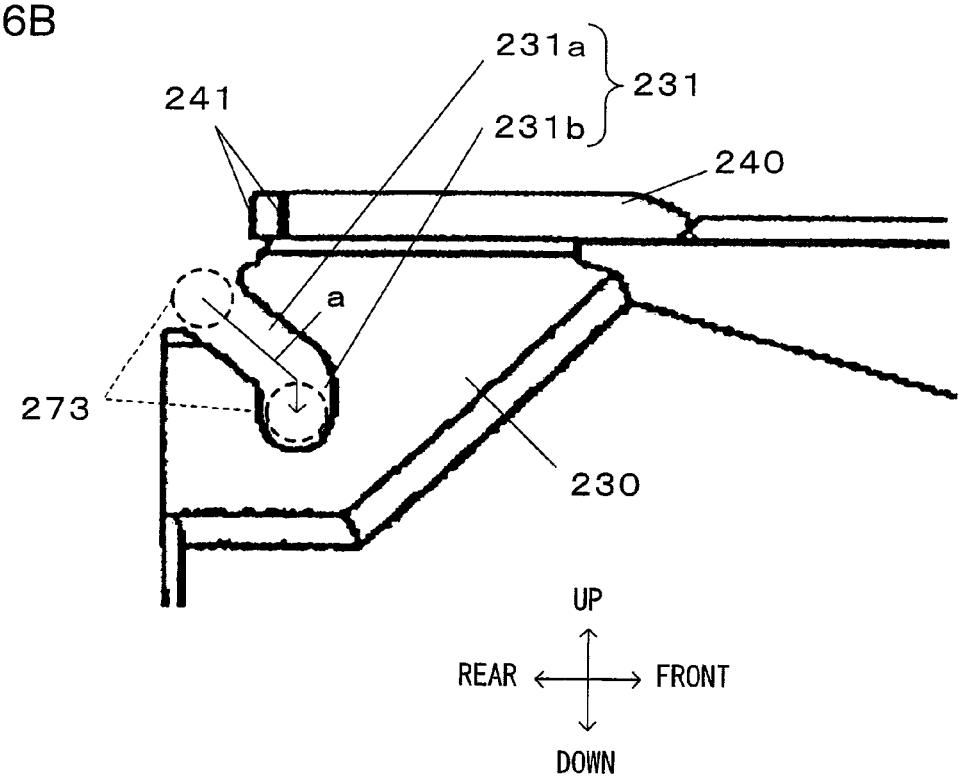

When the front block 210 and the rear block 250 are joined as described above, the front block 210 and the rear block 250 pivotally support each other via the connection pin 225. An anti-clockwise rotation in FIG. 2 of the front block 210 about the connection pin 225 (clockwise rotation of the rear block 250) is controlled by the abutment surface 241 of the abutment section 240 and the abutment surface 281 of the abutment section 280 abutting against each other in face contact. A clockwise rotation in FIG. 2 of the front block 210 about the connection pin 225 (anti-clockwise rotation of the rear block 250) is controlled by, as shown in FIG. 6B, the pin 273 at the bottom of the groove section 231*b* (i.e. the fixed position) abutting against the rear inner surface of the groove section 231*b*. Accordingly, when the front block 210 and the rear block 250 are joined as described above, the front block 210 and the rear block 250 are fixed to each other. It is to be noted that the lower joining section 260 is inserted and sandwiched between the two lower joining sections 220 separate right and left and the upper joining section 230 is inserted and sandwiched between the two upper joining sections 270 separate right and left. As a result, the front block 210 and the rear block 250 are controlled with respect to right and left movement each other.

Figure 14:
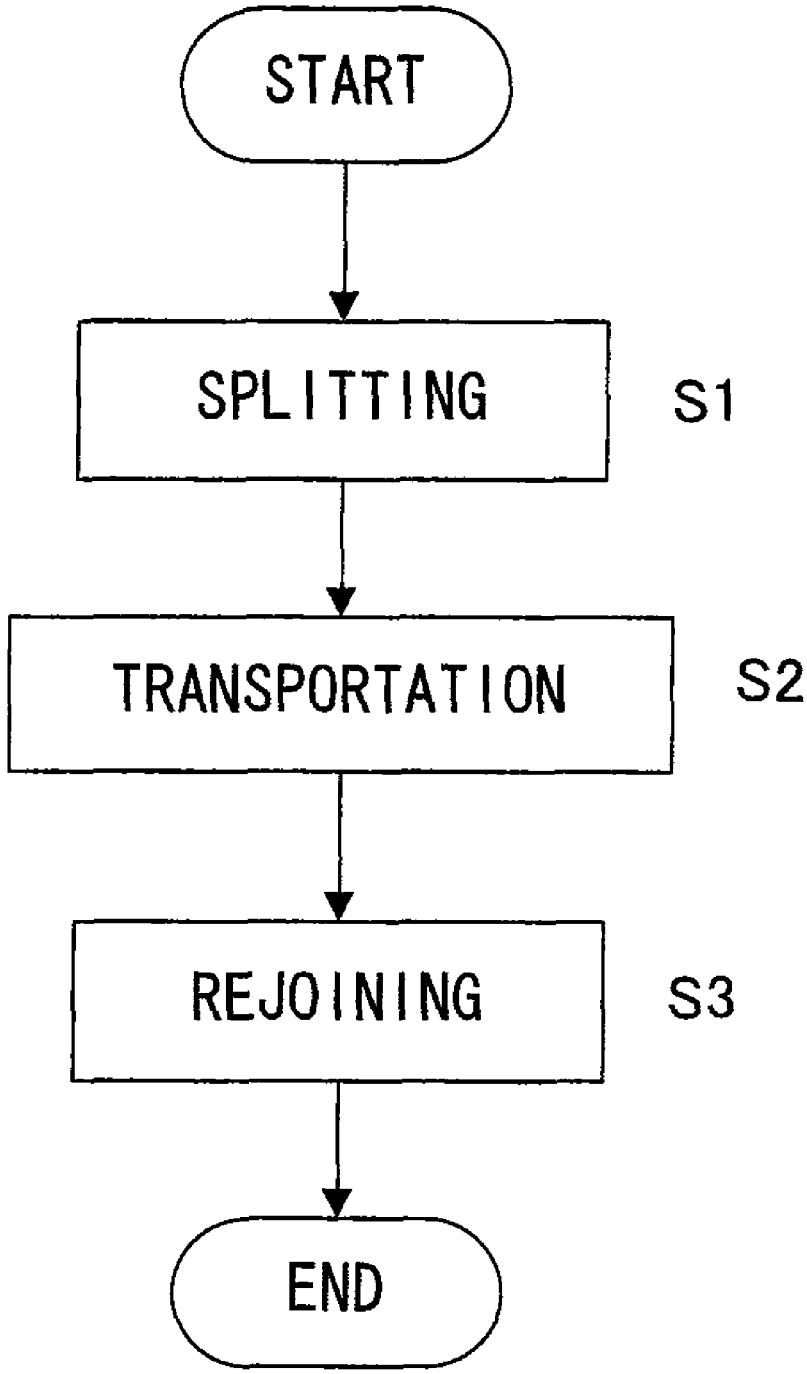
FIG. 14 is a flowchart of a transportation method for transporting the rotating superstructure 2.

FIG. 14 shows a flowchart of a transportation method for transporting the rotating superstructure 2. In step S1, the rotating superstructure 2 is split into the front block 210 on which the operator's cab 5 and the power unit are mounted and the rear block 250 on which the live mast 4 and the unit for raising and lowering a boom are mounted. In step S2, the front block 210 and the rear block 250 are separately transported. The live mast 4 is transported together with the rear block 250. In step S3, as explained above, the front block 210 and the rear block 250 are rejoined after transportation.

—Force Applied to the Main Frame 200 in Operation—

Figure 12:
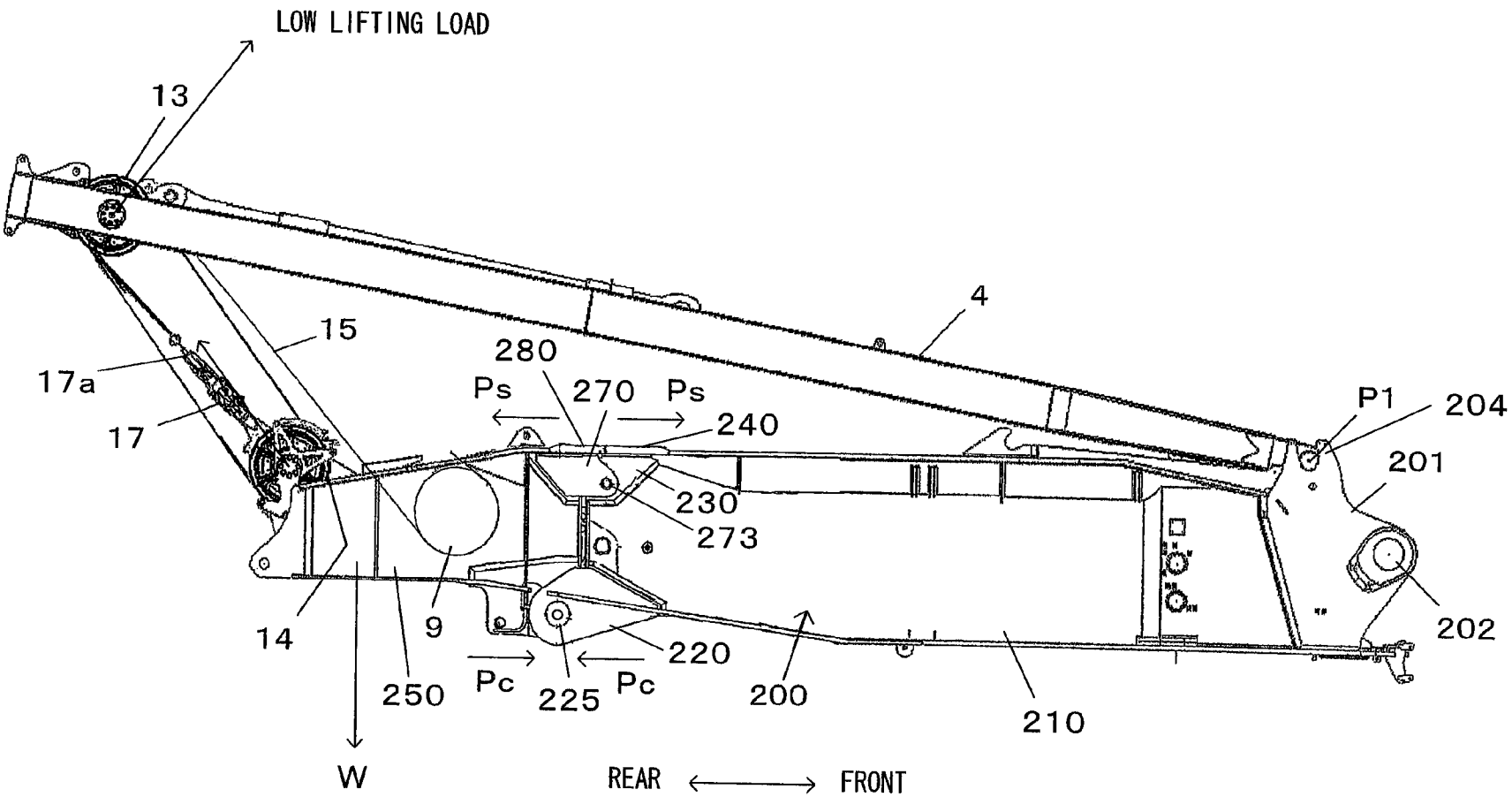
FIG. 12 is a view explaining force applied to the main frame 200 in the event that no or low lifting load is applied.

In the event that no or low lifting load is applied, as shown in FIG. 12, since tension from the pendant rope 12 (refer to FIG. 1) is low, tension on the 15 is also low. Thus, a downward force is applied to the rear block 250 with a weight W of the counterweight 6, which presses down the rear end. Therefore, a compression force Pc is applied to the lower section of the front block 210 and the rear block 250 and a tensile force Ps is applied to the upper section of the front block 210 and the rear block 250. Although shear force is applied to the connection pin 225 under the compression force Pc on the lower section of the front block 210 and the rear block 250, the diameter of the connection pin 225 is determined so as to have a sufficient strength, therefore the connection pin 225 can sufficiently withstand the compression force Pc (shear force).

Since the pin 273 in the fixed position abuts against the rear inner surface of the groove section 231*b* under the tensile force Ps on the upper section of the front block 210 and the rear block 250, shear force is applied to the pin 273. However, the diameter of the pin 273 is determined so as to have a sufficient strength, and therefore the pin 273 can sufficiently withstand the tensile force Ps (shear force). It is to be noted that since the shear force applied to the pin 273 is lower than that applied to the connection pin 225 in the event that lifting load is high as described later, it is acceptable that the diameter of the pin 273 is smaller than that of the connection pin 225.

Figure 13:
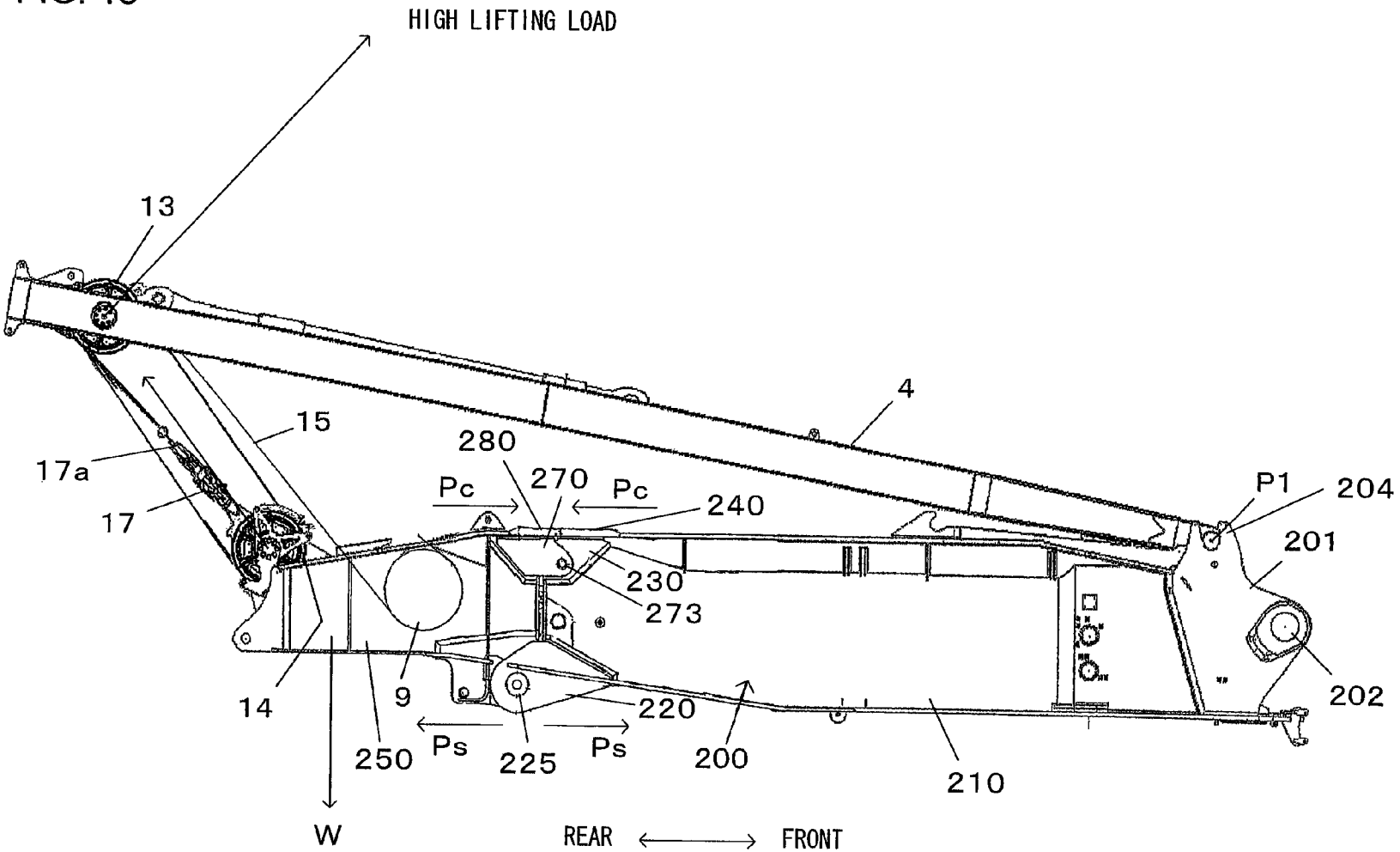
FIG. 13 is a view explaining force applied to the main frame 200 in the event that a high lifting load is applied.

In the event that the lifting load is high, as shown in FIG. 13, since tension from the pendant rope 12 is high, tension on the 15 is also high. Thus, an upward force is applied to the rear block 250 against the weight W of the counterweight 6, which pushes up the rear end. Therefore, the tensile force Ps is applied to the lower section of the front block 210 and the rear block 250 and the compression force Pc is applied to the upper section of the front block 210 and the rear block 250. Although shear force is applied to the connection pin 225 under the tensile force Ps on the lower section of the front block 210 and the rear block 250, the diameter of the connection pin 225 is determined so as to have a sufficient strength, therefore the connection pin 225 can sufficiently withstand the tensile force Ps (shear force).

The abutment surface 241 of the abutment section 240 and the abutment surface 281 of the abutment section 280 abut against each other under the compression force Pc on the upper section of the front block 210 and the rear block 250. The abutment surfaces 241 and 281 are in face contact with each other and hold the compression force Pc. The thickness of the abutment sections 240 and 280 is designed so as to sufficiently withstand the compression force Pc.

Thus, in the present embodiment, even though the main frame 200 possesses a split configuration, it is structured so as to rationally hold the force applied to each of the sections and have a sufficient strength.

The following operations and advantageous effects can be achieved according to the embodiment described above.

(1) In the event of a conventional rotating superstructure having a main frame which does not have a split configuration, since the length of the rotating superstructure with the live mast being attached thereto may exceed the limit of the permitted length for transportation, the rotating superstructure and the live mast 4 need to be transported separately. However, since the wire rope is wound between the live mast 4 and the winch, not only the live mast 4 but also the winch needs to be separated from the rotating superstructure. In addition, when the live mast 4 and the winch are transported, the winch needs to be temporarily fixed to the live mast 4 and, after the transportation, the arm and the winch need to be reattached to the rotating superstructure. Accordingly, assembly and disassembly for transportation of the conventional rotating superstructure may become complicated.

On the other hand, in the present embodiment, the main frame 200 of the rotating superstructure 2 can be split into the front block 210 on which power unit is mounted and the rear block 250 on which the unit for raising and lowering a boom is mounted. As a result, the live mast 4 and the front block 210 can be separated without separating the unit and the live mast 4 and without removing the unit from the rear block 250. In other words, the unit, the live mast 4, and the rear block 250 are integrally separated from the front block 210. Accordingly, assembly and disassembly for transportation become easy and excess of the permitted length for transportation can be easily avoided.

(2) The power unit is mounted on the front block 210 and the unit is mounted on the rear block 250. More specifically, those devices that are hard to separate from the live mast 4 are aggregated in the rear block 250 and those devices that are not hard to separate from the live mast 4 such as the power unit are aggregated the front block 210. This configuration results in a reduction in the number of join/unjoin portions of hydraulic piping and electrical wiring when the front block 210 and the rear block 250 are joined/unjoined, thereby allowing the front block 210 and the rear block 250 to be easily joined/unjoined.

(3) As shown in FIG. 6B, the pin guiding groove 231 is configured so as to guide the pin 273 attached to the rear block 250 to the fixed position when the front block 210 and the rear block 250 are joined and so as to lock the pin 273 in order to prevent the front block 210 and the rear block 250 from being separated after joining the blocks. This configuration allows the front block 210 and the rear block 250 to be easily joined/unjoined.

(4) In the event that no or low lifting load is applied, the pin 273 at the fixed position abuts against the rear inner surface of the groove section 231*b*. In the event that high lifting load is applied, the abutment surface 241 of the abutment section 240 and the abutment surface 281 of the abutment section 280 abut against each other. This configuration rationally holds the force applied to each of the sections so as to assure a sufficient strength even though the main frame 200 possesses a split configuration.

(5) The connection pin 225 is inserted into the pin through-hole 221 and the pin through-hole 261 so as to fix the lower joining section 220 of the front block 210 and the lower joining section 260 of the rear block 250. This configuration achieves a sufficient strength and an easy join/unjoin of the lower joining sections 220 and 260.

—Variations—

(1) While in the above explanation, the pin guiding groove 231 is provided on the upper joining section 230 of the front block 210 and the pin retaining hole 271 that retains the pin 273 is provided on the upper joining section 270 of the rear block 250, the present invention is not limited thereto. For example, the pin retaining hole 271 that retains the pin 273 may be provided on the front block 210 and the pin guiding groove 231 may be provided on the rear block 250.

(2) While in the above explanation, the present invention is applied to a crane that includes a live mast as a mast member, the present invention may also be applied to a crane that includes another mast member (for instance, A frame, etc.).

(3) Each of the embodiments and the modifications may be adopted in combination.

It is to be noted that the present invention may be embodied in any way other than those described in reference to the embodiments and that the present invention is provided with a front block on which a power unit including a prime mover is mounted and a rear block on which a unit for raising and lowering a boom including a winch, a, and a arm are mounted and includes a rotating superstructure in various structures characterized by being splittable into the front block and the rear block and a crane in various structures having the rotating superstructure.

What is claimed is:

1. A rotating superstructure, comprising:

a front block on which is arranged a power unit that includes a prime mover; and a rear block on which is arranged a unit for raising and lowering a boom that includes a winch and a sheave, wherein:

the rotating superstructure is configured to be split into the front block and the rear block;

a first abutment section having a first abutment surface is provided at an end of the front block at a side joining with the rear block, the first abutment section being a plate-like member;

a second abutment section having a second abutment surface is provided at an end of the rear block at a side joining with the front block, the second abutment section being a plate-like member; and when the front block and the rear block are joined together, the first abutment surface of the first abutment section and the second abutment surface of the second abutment section contact each other in face contact to receive compressive forces.

2. A rotating superstructure according to claim 1, further comprising:

a pin that is provided on either one of the front block and the rear block so as to join the front block and the rear block each other;

a pin fix member that is provided on the other one of the front block and the rear block, includes a guiding section so as to guide the pin to a fixed position when the front block and the rear block are joined to each other, and includes a lock section that locks the pin at the fixed position so as to prevent the front block and the rear block from being separated after the pin is guided to the fixed position.

3. A rotating superstructure according to claim 1, further comprising:

a mast for raising and lowering a boom, wherein the rear block includes a member on which the mast is placed during transportation.

4. A rotating superstructure according to claim 1, wherein the rotating superstructure is for a crane.

5. A crane comprising:

a rotating superstructure according to claim 1; and a traveling undercarriage on which the rotating superstructure is rotatably mounted.

6. A crane according to claim 5, wherein:

the first abutment section and the second abutment section are provided so that the first abutment surface and the second abutment surface are contacted to each other in face contact when lifting load is applied to the crane.

7. A crane according to claim 5, wherein:

the front block and the rear block are pivotally joined to each other via a connection pin at lower sides of the front block and the rear block;

the first abutment section is provided at an upper side of the front block;

the second abutment section is provided at an upper side of the rear block; and a rotation of the front block and the rear block around the connection pin is controlled by the first abutment surface and the second abutment surface contacting each other in face contact at upper sides of the front block and the rear block when lifting load is applied to the crane.

8. A crane according to claim 5, further comprising:

a pin that is provided on either one of the front block and the rear block so as to join the front block and the rear block to each other; and a pin fix member that is provided on the other one of the front block and the rear block, includes a guiding section so as to guide the pin to a fixed position when the front block and the rear block are joined to each other, and includes a lock section that locks the pin at the fixed position so as to prevent the front block and the rear block from being separated after the pin is guided to the fixed position, wherein:

the front block and the rear block are pivotally joined to each other via a connection pin at lower sides of the front block and the rear block, the first abutment section is provided at an upper side of the front block, the second abutment section is provided at an upper side of the rear block, a rotation of the front block and the rear block around the connection pin is controlled by the first abutment surface and the second abutment surface contacting each other in face contact at upper sides of the front block and the rear block when lifting load is applied to the crane, and a rotation of the front block and the rear block around the connection pin is controlled by the pin and the lock section of the pin fix member contacting each other when lifting load is not applied to the crane.

9. A rotating superstructure according to claim 1, wherein:

the front block and the rear block are pivotally joined to each other via a connection pin; and a rotation of the front block and the rear block around the connection pin is controlled by the first abutment surface and the second abutment surface contacting each other in face contact.

10. A method for transporting a rotating superstructure, comprising:

splitting a rotating superstructure according to claim 1 into the front block and the rear block;

transporting the front block and the rear block separately; and rejoining the front block and the rear block into the rotating superstructure after transportation.

11. A method for transporting a rotating superstructure according to claim 10, wherein a mast for raising and lowering a boom is transported together with the rear block.

12. A rotating superstructure, comprising:

a front block on which is arranged a power unit that includes a prime mover; and a rear block on which is arranged a unit for raising and lowering a boom that includes a winch and a sheave, wherein:

the rotating superstructure is configured to be split into the front block and the rear block, a first abutment section having a first abutment end face contact surface is provided at an end of the front block at a side facing the rear block, a second abutment section having a second abutment end face contact surface is provided at an end of the rear block at a side facing the front block, and when the front block and the rear block are joined together, the first abutment end face contact surface of the first abutment section and the second abutment end face contact surface of the second abutment section are aligned to permit end face-to-end face contact for receiving compressive force between the front and rear blocks.

* * * * *